United States Patent [19]

Mishima

[11] Patent Number: 4,511,261

[45] Date of Patent: Apr. 16, 1985

[54] WRISTWATCH PROTECTOR

[76] Inventor: Mitsutaka Mishima, No. 30, 2-chome, Ohashi, Miyazaki-shim, Miyazaki-ken, Japan, 880

[21] Appl. No.: 648,331

[22] Filed: Sep. 5, 1984

Related U.S. Application Data

[63] Continuation of Ser. No. 455,942, Dec. 15, 1982, abandoned.

[51] Int. Cl.[3] ..... G04B 37/00

[52] U.S. Cl. ..... 368/286

[58] Field of Search ..... 368/286, 287; 224/170, 224/173, 178

[56] References Cited

U.S. PATENT DOCUMENTS

| | | | |
|---|---|---|---|
| 2,511,105 | 6/1950 | Fentuessy | 368/286 |
| 2,565,822 | 8/1951 | McClelland | 368/286 |
| 2,582,473 | 1/1952 | Belfert | 368/286 |
| 2,635,416 | 4/1953 | Mietchen | 368/286 |
| 3,712,049 | 1/1973 | Luxembourg | 368/286 |
| 4,277,842 | 7/1981 | Richards | 368/286 |

FOREIGN PATENT DOCUMENTS

| | | | |
|---|---|---|---|
| 105694 | 4/1917 | United Kingdom | 368/286 |
| 766117 | 1/1957 | United Kingdom | 368/286 |

*Primary Examiner*—Vit W. Miska

*Attorney, Agent, or Firm*—Parkhurst & Oliff

[57] ABSTRACT

A buffer is made so as to be attached to the glass face of a wristwatch so that the glass of the watch is protected from damage by touching rock or so on. The buffer is attached to the watch straps by attachments made at the ends of the buffer. The buffer is made of a flexible substance such as rubber, and is also made so as not to obstruct the reading of the time of the watch.

5 Claims, 2 Drawing Figures

WRISTWATCH PROTECTOR

This is a continuation of application Ser. No. 455,942 filed Dec. 15, 1982, now abandoned.

BACKGROUND OF THE INVENTION

A wrist watch can easily have scratch marks on its blass face even under best condition. Especially a scuba watch can very easily have many scratch marks since it often touches to rock or sands under the sea.

In the prior art, there is no protection therefrom. Therefore, when the glass of the watch has many scratch marks or the glass is broken, the glass is just replaced to new one.

A wrist watch protector of the present invention provides a protector for a wrist watch from damage.

SUMMARY OF THE INVENTION

A buffer or protector is so made as to be attached to surface of glass of a wrist watch so that the glass is protected from damage by touching rock, sands or so on.

The buffer has attatchments at the ends thereof. Thereby, the buffer is attatched to the wrist watch straps. Consequently the wrist watch protector can be firmly attatched to the watch.

The buffer is made of not hard thing such as metal but flexible thing such as rubber so that the buffer will not give a damage to the watch and will absorb shocks by touching the watch to rock or so.

The buffer is also so made as not to obstruct that time of the watch can be read. Therefore the buffer is made of transparent or semitransparent thing and/or forms a string, strings or a net.

Such a simple construction protects a wrist watch surface from damage so much.

IN THE DRAWINGS

DESCRIPTION OF THE PREFERRED EMBODIMENTS

Figure 1:
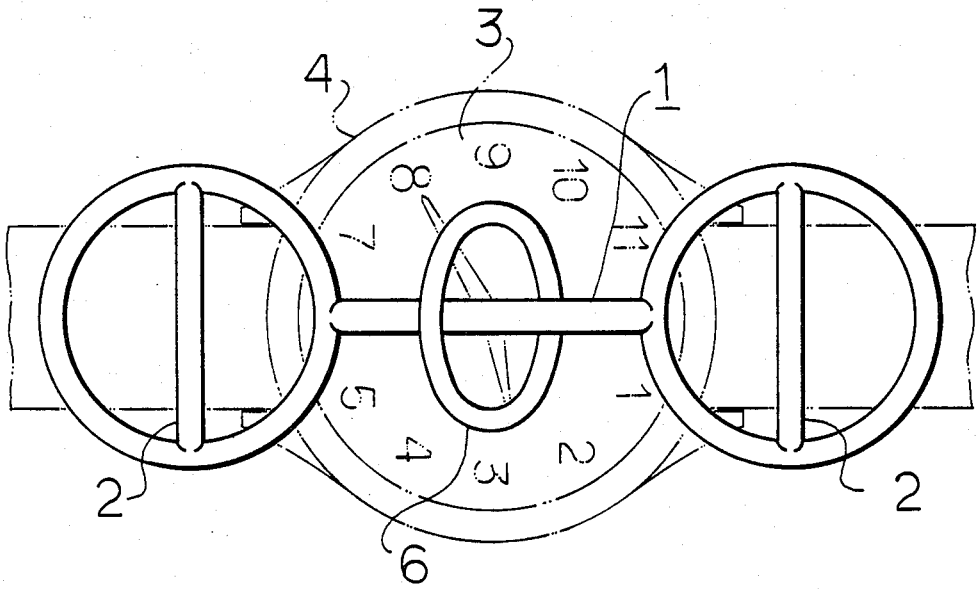
FIG. 1 is a plane view of a wrist watch protector emboding the present invention.

As shown in FIG. 1, a buffer 1 has attatchments 2 at the ends thereof. Thickness and/or form of the buffer 1 are/is not limitted to special ones. However they must be suitable for attatching to surface of glass 3 of a wrist watch 4, and for protecting the watch 4 from damage by touching rock, sands or so on, and also for reading time of the watch 4. One example of them is shown in the drawings.

Material of the buffer 1 is flexible one such as rubber, neoprene or so on so that the buffer 1 will absorb shocks to the watch glass 3 by touching rock so on. If the buffer 1 is made of transparent or semitransparent thing, it is possible to form covering all or almost all of the surface 3 of the watch 4.

Figure 2:
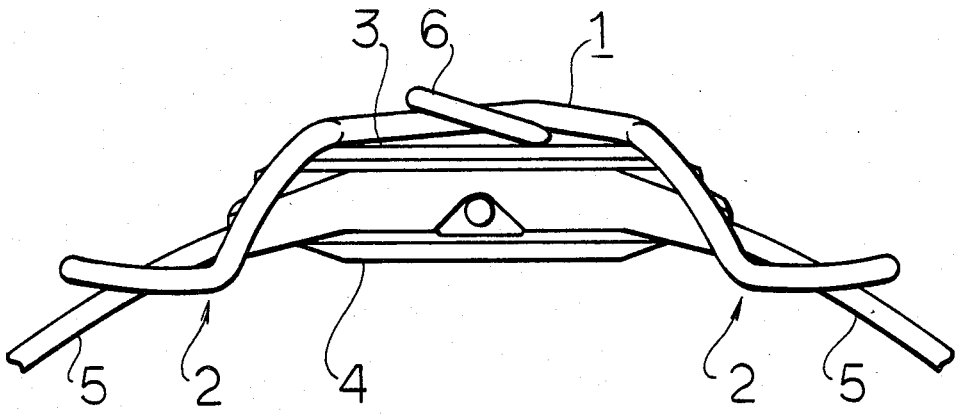
FIG. 2 is a side view of the wrist watch protector attatched to a wrist watch.

The attachments 2 of the buffer 1 are attached to the inside of the wrist watch straps 5 as shown in FIG. 2. Thereby, the buffer 1 can be attached to the surface of the glass 3, and the wrist watch protector can be firmly attached to the watch 4.

The buffer can be formed a string, strings, net, ripple-shaped one, project-shaped one or combination of more than one of them.

The ring 6 of the buffer 1 of the FIGS. 1 and 2 of the embodiment of the present invention gives the buffer 1 more buffer efect, since the ring 6 not only covers more surface of the glass 3 of the watch 4 but also lifts the buffer 1 which makes margin between the buffer 1 and the surface of the glass 3 of the watch 4.

I claim:

1. A non-metallic protector for a wristwatch comprising:

first and second means for attachment to a wristband, each having an outer ring portion with a bar extending across the center thereof such that the wristwatch band may be extended through and held by said means;

a buffer bar connecting said first and second attachment means such that when said first attachment means holds said band on one side of a wristwatch and said second attachment means holds said band on the other side of said wristwatch, said buffer bar extends across the face of said wristwatch without significantly obscuring said face;

ring means encircling but not fixedly attached to said buffer bar such that a portion of said interlocking ring means lifts at least a portion of said buffer bar away from said wristwatch face so as to form a margin of space between said face and said buffer, and such that said ring means itself protects a substantial portion of said face without significantly obscuring said face.

2. A protector according to claim 1 wherein said buffer comprises a flexible material.

3. A protector according to claim 2 wherein said flexible material is selected from the group consisting of rubber and neoprene.

4. A protector according to claim 1 wherein said non-metallic buffer is of a transparent material.

5. A protector according to claim 1 wherein said non-metallic buffer is of a semi-transparent material.

* * * * *